US006141515A

United States Patent [19]

Takeda et al.

[11] Patent Number: 6,141,515

[45] **Date of Patent: *Oct. 31, 2000**

[54] IMAGE FORMING APPARATUS COMPRISING ULTRASONIC MOTORS

[75] Inventors: Kenji Takeda, Yokohama; Naruto Sugimoto, Machida; Norio Matsui, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/783,849

[22] Filed: Jan. 16, 1997

[30] Foreign Application Priority Data

Jan. 19, 1996 [JP] Japan ..... 8-026108

[51] Int. Cl.[7] ..... G03G 15/00

[52] U.S. Cl. ..... 399/167; 399/75

[58] Field of Search ..... 399/167, 36, 37, 399/38, 76, 75; 310/316, 317, 323, 328; 318/114, 127

[56] References Cited

U.S. PATENT DOCUMENTS

| | | | |
|---|---|---|---|
| 4,748,474 | 5/1988 | Kurematsu et al. | 399/159 |
| 5,327,339 | 7/1994 | Takeda et al. | 347/119 |
| 5,515,139 | 5/1996 | Hou et al. | 399/38 |
| 5,521,455 | 5/1996 | Miyazawa et al. | 310/323 |

FOREIGN PATENT DOCUMENTS

| | | |
|---|---|---|
| 1-179055 | 7/1989 | Japan . |
| 2-304576 | 12/1990 | Japan . |
| 5-294491 | 11/1993 | Japan . |
| 6-149137 | 5/1994 | Japan . |
| 6-149138 | 5/1994 | Japan . |
| 8-95327 | 4/1996 | Japan . |
| 8-160829 | 6/1996 | Japan . |

*Primary Examiner*—Sophia S. Chen
*Attorney, Agent, or Firm*—Fitzpatrick, Cella, Harper & Scinto

[57] ABSTRACT

The present invention relates to an image forming apparatus which forms the multiple image by transferring the color toner images onto the transfer material sequentially. In such apparatus the drive source is provided for each image bearing member to rotate it. The ultrasonic motor is suitably used as the drive source and is attached to the rotary shaft thereof to detect rotating condition of the motor.

25 Claims, 16 Drawing Sheets

IMAGE FORMING APPARATUS COMPRISING ULTRASONIC MOTORS

BACKGROUND OF THE INVENTION

1. Field of the Invention

This invention relates to an image forming apparatus of the electrophotographic type called, for example, a full color copying apparatus or a full color printer, and particularly to an image forming apparatus provided with a plurality of image bearing members for forming a multiple image by transferring color toner images to a transfer material sequentially.

2. Related Background Art

FIG. 9 of the accompanying drawings shows a full color image forming apparatus which is a full color copying apparatus of so-called four-drum construction using four photosensitive drums.

Referring to FIG. 9, the full color image forming apparatus 30 is such that an original is placed on an automatic original conveying device DF and when a start button (not shown) is depressed by a user, a sheet (transfer material) S is fed from a cassette 1*a* or a cassette 1*b*. The sheet S stands by at regist rollers 2 in order to take timing with an image forming portion. In the meantime, the original is conveyed onto an original supporting table 3 and is scanned by an optical system 4 and is read into a CCD. Here, the image of the original is resolved into components, i.e., a yellow image (Y), a magenta image (M), a cyan image (C) and a black image (Bk).

A laser beam is then turned on and off for each component, whereby in image forming portions for Y, M, C and Bk, development is effected on photosensitive drums (image bearing members) 5Y, 5M, 5C and 5Bk.

In the image forming portions, there are primary chargers 6Y, 6M, 6C and 6Bk for uniformly charging the photosensitive drums 5Y, 5M, 5C and 5Bk, respectively, developing devices 9Y, 9M, 9C and 9Bk for developing latent images into visible images, transfer chargers 7Y, 7M, 7C and 7Bk for transferring the visible images onto the sheet S, and cleaning devices 8Y, 8M, 8C and 8Bk for removing any residual toners on the photosensitive drums 5Y, 5M, 5C and 5Bk.

Also, there is disposed a transfer belt 19 extending through the image forming portions for Y, M, C and Bk, and each color image is transferred to the sheet S while the sheet S standing by at the regist rollers 2 is electrostatically attracted onto and conveyed on the transfer belt 19 in timed relationship with the development on the photosensitive drums. Thus, the image formation in a superposed state is sequentially effected on the sheet S. Thereafter, the sheet S is conveyed to a fixating device 10, where the toner images are melted and fixated, and the sheet S is discharged out of the apparatus onto a tray 20.

When both-surface images are to be formed, after the first surface of the sheet S has been subjected to the fixating step by the fixating device 10, the sheet S is directed downwardly by a flapper 12 located at the entrance to a both-surface conveying path, is reversed by a reversing portion 15, passes along a conveying path 32 and is placed onto an intermediate tray 31. Thereafter, the original is interchanged, sheet resupply is effected and the sheet S is again sent to the image forming portions, where images are formed on the second surface of the sheet S, and the sheet S passes through the fixating device 10 and is placed onto the tray 20 outside the apparatus.

In the apparatus shown in FIG. 9, a drive system as shown in FIG. 10 of the accompanying drawings has heretofore been adopted as a driving construction for the plurality of photosensitive drums 5. A drum driving pulley 41 is mounted on the central shaft of each photosensitive drum 5, and those pulleys are driven by a timing belt 42 for driving by rotating a drive pulley 43*a* mounted on the output shaft of a relatively inexpensive DC motor 43 from which a rotation output of good accuracy is obtained during high-speed rotation Usually the highly accurate high speed rotation output of the DC motor 43 is decelerated by the pulley/belt and is transmitted to each photosensitive drum 5.

FIG. 11 shows the drum driving portion shown in FIG. 10 in greater detail. The photosensitive drum 5 is coaxially supported on a drum shaft 38 journalled by bearings 39*b* and 39*a* attached to a body side plate 34 and an aligning plate 36, respectively, mounted on the other body side plate 35, through drum flanges 5*a* and 5*b*, and is integrally fixed to the drum shaft 38 by a stopper 37. That is, the construction in which the plurality of photosensitive drums which are a plurality of driven members are driven by a single drive source (DC motor) rotated at high speed, through mechanical elements such as a timing belt and pulleys or gears or the like (not shown) is adopted in almost all of the full color copying apparatuses or color printers according to the prior art.

Also, the DC motor is usually provided with means such as an encoder for making the number of output revolutions of the motor high and detecting the rotated state in the interior of the motor so that predetermined rotation accuracy may be obtained, and the control of the rotation thereof is effected on the basis of a detected signal.

However, the drum driving construction according to the above-described example of the prior art has suffered from disadvantages arising from what will be described hereinafter.

When the photosensitive drums 5, the drum flanges 5*a*, 5*b* and the drum shafts 38 are to be assembled, the respective members are sometimes in contact with one another only at a certain point and assembled in an inclined state due to the backlash at the fitted portions of the respective members or the inconvenience of the shapes thereof (because it is difficult to make them into a completely circular shape). This is such as shown in FIG. 12 of the accompanying drawings. That is, as shown in FIG. 12, in the above-described state, there is created a deviation between the center $\mathbf{38}_0$ of the drum shaft 38 and the center $\mathbf{5}_0$ of the photosensitive drum 5, in other words, between the center of the drive transmitting member and the center of the driven member. As a result, the drum shaft 38 and the drum flange 5*a* (5*b*) contact with each other at a point $C_1$, and the drum flange 5*a* (5*b*) and the photosensitive drum 5 contact with each other at a point $C_2$.

The graph of FIG. 13 of the accompanying drawings shows a change in the distance from the center $\mathbf{38}_0$ of the drum shaft 38 to the surface of the photosensitive drum 5 in the direction of arrow θ in FIG. 12. When with the drum shaft 38 as the reference, the photsensitive drum 5 is rotated in the state of the distance change shown in the graph of FIG. 13, there is a member (a cleaning blade or the like) directly contacting with the photosensitive drum 5 around the photosensitive drum 5. Therefore, the drum shaft 38 receives a load from that member through the photosensitive drum 5, and the rotational speed of the drum shaft 38 causes a periodic fluctuation relative to a desired speed during each rotation of the photosensitive drum 5.

When at that time, the drum driving of the apparatus is that shown in FIG. 10, a mechanical element (the timing belt 42 for driving or the like) is interposed between the drive source (the DC motor 43) and the driven member (the drum driving pulley 41), whereby it is difficult for the speed fluctuation of each photosensitive drum 5 to be quickly transmitted to speed detecting means in the drive source without delay. Therefore, each photosensitive drum 5 has been rotated while causing a speed fluctuation during each one full rotation thereof to thereby effect image formation. An image obtained under such a situation will now be described.

In the apparatus effecting the drum driving shown in FIG. 10, grating images at equal intervals for two surfaces are formed by the use of two photosensitive drums 5, as shown in FIG. 14 of the accompanying drawings, and multiplex transfer is effected with the images deviated by a certain distance (half pitch) on a sheet of paper, and the graph of FIG. 15 of the accompanying drawings shows the distance between the first and second gratings from the leading end to the trailing end of the sheet. In FIG. 14, there are shown the state of the image on the sheet at that time and measured portions ($a_1$, $a_2$, . . . , $b_1$, $b_2$, . . . ). In FIG. 15, it is seen that the distance between adjacent gratings changes with a certain constant period. The change in the behavior of a line (envelope) linking the upper points in this graph together (the changes in $a_1$, $a_2$, . . . in FIG. 14) is the amount of deviation between two images, and that amount is great and changes periodically.

FIGS. 16A and 16B of the accompanying drawings show images similar to FIG. 15 with one of the fixed positions thereof relative to the drum shafts of two photosensitive drums (in FIG. 12, the relation to the position of the center $\mathbf{5}_0$ of the photosensitive drum 5 and the position of the center $\mathbf{38}_0$ of the drum shaft 38) being a certain position and the other being an image obtained when a part thereof has been changed, and in FIG. 16B, the fixed position of one of the photosensitive drums is replaced with that of FIG. 16A. From FIGS. 16A and 16B, it is seen that the behavior of the images fluctuates from location to location and the amount thereof also changes.

That is, when image formation is to be effected in the apparatus adopting the drive system shown in FIG. 10, a stable image (a pattern in which the peaks/valleys shown in FIGS. 16A and 16B appear constantly) is obtained only when design is made such that the relation of each photosensitive drum to the drum shaft always becomes constant. That is, a constant method of assembly is always required during the assembly of the apparatus and the interchange of the photosensitive drums.

The periodicity of the image shown in FIG. 15 will now be described with reference to FIGS. 17, 18A and 18B of the accompanying drawings.

FIG. 17 shows a measuring method carried out to find out the periodicity. The laser beam of a laser Doppler speedometer is applied near to the same points on the side surface (the measuring points indicated by X in FIG. 17) on drum driving pulleys 41 made integral with two photosensitive drums 5 on which image formation has been effected, to thereby detect speed waveforms ($V_3$ and $V_4$ in FIG. 17) corresponding to a constant time at the measuring points at the same times. FIG. 18A shows the mutual correlation between $V_3$ and $V_4$ detected by a frequency analyzer, and FIG. 18B shows what has been obtained by frequency-analyzing it.

That is, in the graph shown in FIG. 18B, the frequency component of a portion in which there is a peak affects the speed waveforms of the two photosensitive drums, and that frequency is a frequency component created by one full rotation of the photosensitive drum. That is, the speed fluctuation created by each one full rotation of the photosensitive drum relates between the speeds of the two photosensitive drums, and it affects an image formed. That component is basic one created by each one full rotation of each photosensitive drum. Therefore, as shown in FIG. 15, the image becomes wide or narrow at the period of each one full rotation of the photosensitive drum. In other words, the speed fluctuation occurring due singly to the photosensitive drum affects the images formed on the plurality of photosensitive drums.

What has been described above will be further described by the use of expressions as follows.

In FIG. 17, $V_3$ and $V_4$ relate at the period of each one full rotation of the photosensitive drum and are driven by the same driving belt 42 and thus, the speed of each photosensitive drum at the same time is $V_3=V_4=\sin\theta$ ($\theta$ being the rotation angle of the photosensitive drum). However, an image formed at the speed $V_4$ after the paper has advanced by a distance L between the photosensitive drums overlaps an image formed at the speed $V_3$ on the sheet, and therefore the amount of deviation between the images on the two photosensitive drums can be expressed as follows. In the expression below, L is the distance between the photosensitive drums, V is the speed of the sheet, t=L/V is a constant, and $K=2\cdot\sin(t/2)$ is a constant.

The amount of deviation between the images on the two photosensitive drums=(image formed at $V_3$)−(image formed at $V_4$)

$$
\begin{aligned}
&= \int \sin\theta d\theta - \int \sin(\theta + L/V) d\theta \\
&= -\{\cos\theta - \cos(\theta + t)\} \\
&= -2\cdot\sin\cdot(1/2)(2\theta + t)\cdot\sin(1/2)(-t) \\
&= K\cdot\sin(\theta + t/2)
\end{aligned}
$$

As shown by the above expression, the amount of deviation is a trigonometric function which can be represented by the rotation angle of the photosensitive drum, and coincides with the behavior shown in FIG. 15.

That is, in the above-described example of the prior art, all of a plurality of photosensitive drums in which the distance from the center of rotation to the surface changes due to the accuracy or the like of parts during each one full rotation of the drums are driven by a single drive source disposed at a location spaced apart from the group of photosensitive drums which are driven members, through a mechanical element. Therefore, it is difficult for the speed controlling function of the drive source itself to effectively affect each photosensitive drum. Therefore, the images formed by the use of the plurality of photosensitive drums were ones fluctuated during each rotational period of the photosensitive drums. Particularly, when full color images were formed, their behavior appeared as the color misregistration of the images and caused a reduction in the quality of image.

SUMMARY OF THE INVENTION

The present invention intends to solve the above problem in the image forming apparatus in which the multiple images are formed by transferring the color toner images on the transfer material sequentially.

The present invention also intends to improve the quality of image formed by the above image forming apparatus.

For the above purpose, the image forming apparatus for forming a multiple image onto a transfer material by transferring color toner images sequentially comprises (a) a plurality of image bearing members arranged side by side onto which toner images are tranferred, (b) a plurality of drive sources provided corresponding to each of said image bearing members for rotating them, (c) image formation means for forming a toner image on each of said image bearing members, (d) convey means for conveying a transfer material to a toner image transfer position of each of said image bearing members sequentially to thereby transfer the toner image formed on each image bearing member onto the transfer material, and (e) transfer means for transferring the toner image formed on said image bearing member to the transfer material conveyed by said convey means at the transfer position on said image bearing member.

Wherein an ultrasonic motor is used as said drive sources of said image bearing members, said ultrasonic motor having rotation detect means on a rotation shaft thereof for detecting rotation of the ultrasonic motor to control rotation thereof.

DESCRIPTION OF THE PREFERRED EMBODIMENT

Figure 1:
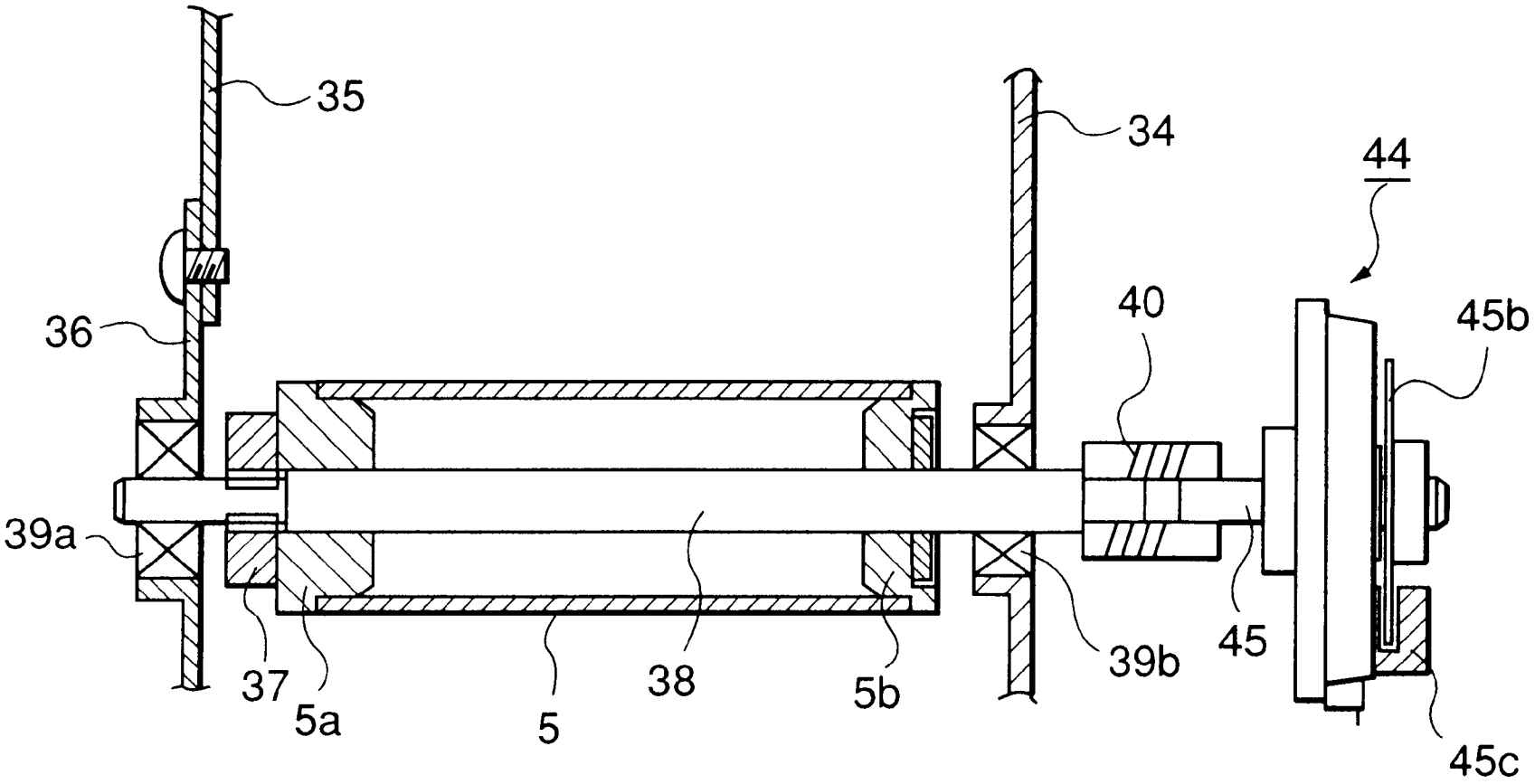
FIG. 1 is an illustration showing an embodiment of a photosensitive drum driving construction according to the present invention.

An image forming apparatus according to the present invention will hereinafter be described in detail with reference to the drawings. In the embodiment described below, the image forming apparatus of the present invention is embodied in the full color image forming apparatus shown in FIG. 9. Accordingly, the detailed description of the general construction and function of the full color image forming apparatus will be omitted and the characteristic portions of the present invention will be described. Also, the same members as those members described previously are given the same reference numerals.

Figure 11:
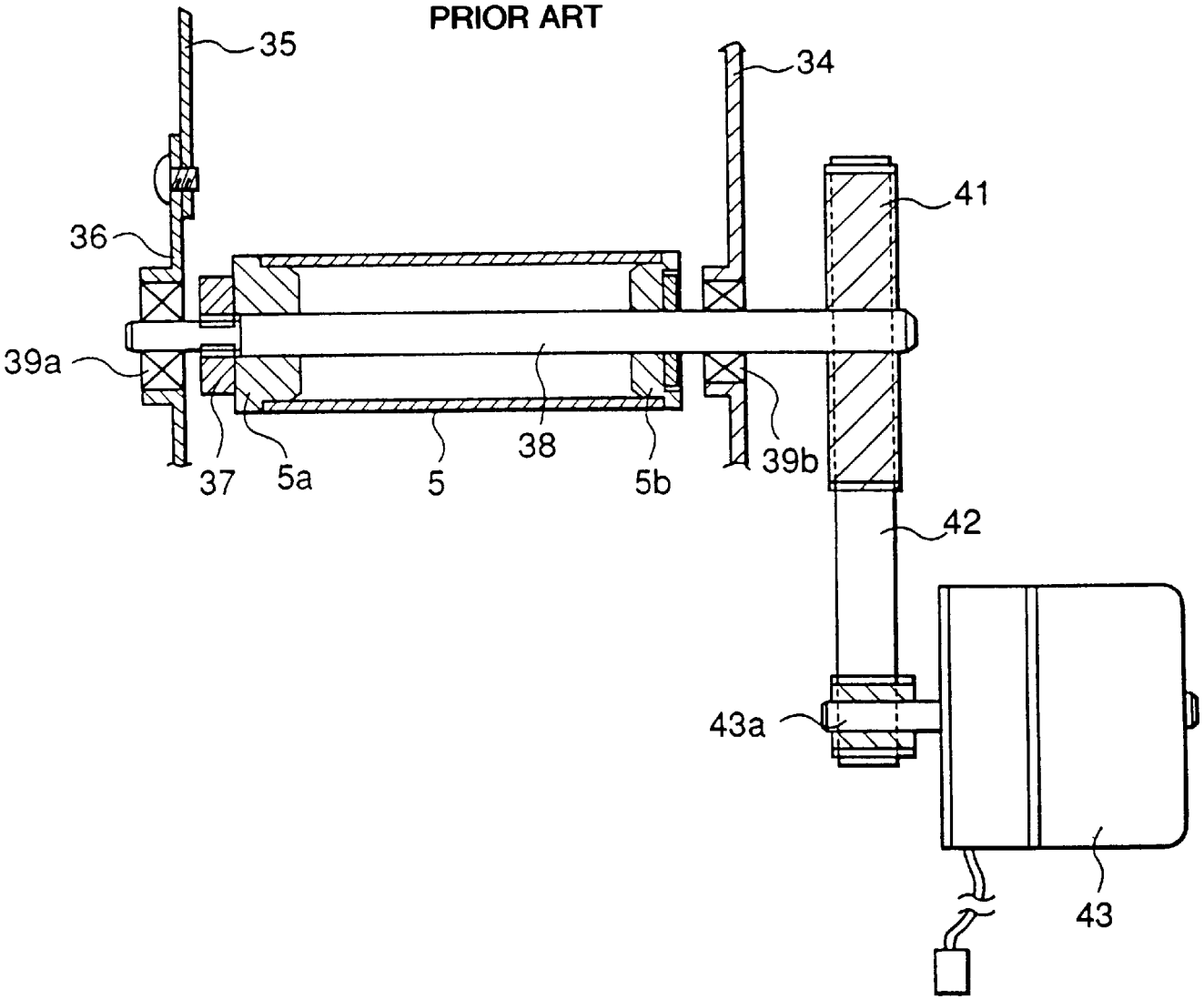
FIG. 11 PRIOR ART
FIG. 11 is a side view showing the photosensitive drum driving construction shown in FIG. 10.
Figure 12:
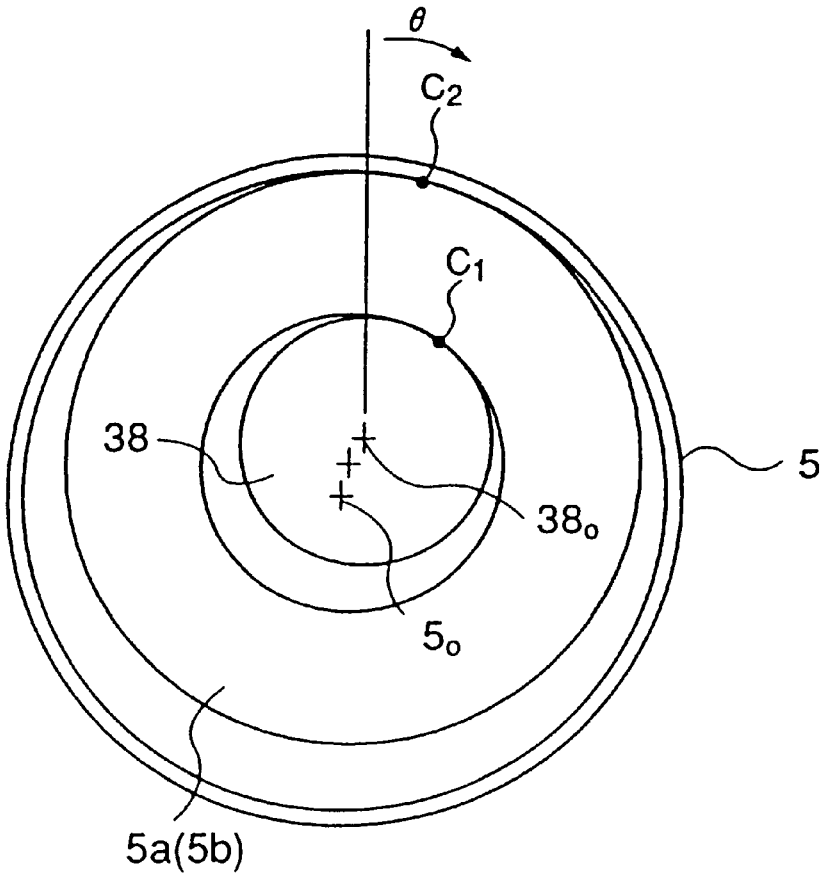
FIG. 12 PRIOR ART
FIG. 12 is an illustration showing the assemblage of a conventional photosensitive drum and a drum shaft.
Figure 13:
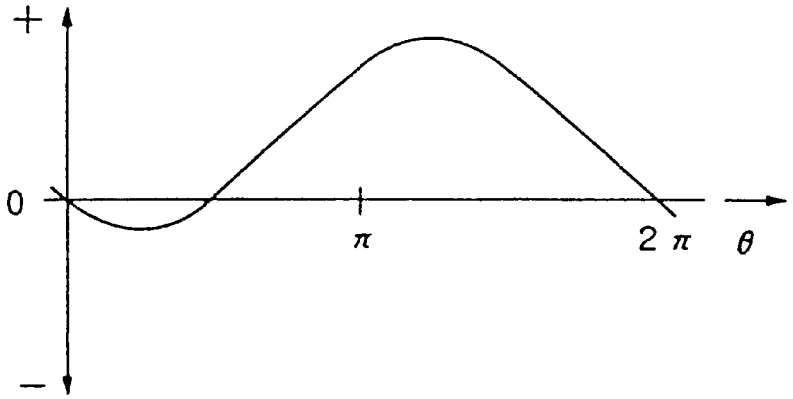
FIG. 13 PRIOR ART
FIG. 13 is a graph showing a change in the distance from the center of the drum shaft of FIG. 12 to the surface of the photosensitive drum.

FIG. 1 shows a driving portion for the photosensitive drum of the image forming apparatus which is a characteristic portion of an embodiment of the present invention. An ultrasonic motor 44 is used as a drive source. The photosensitive drum support portion of the embodiment is substantially similar to the construction shown in FIG. 11, but differs from the latter in the driving and a drive transmitting portion. The photosensitive drum 5 is coaxially supported on a drum shaft 38 journalled by bearings 39*a* and 39*b* attached to a body side plate 34 and an aligning plate 36, through drum flanges 5*a* and 5*b*, and is integrally fixed to the drum shaft 38 by a stopper 37.

Further, the ultrasonic motor 44 is provided on the extension of the drum shaft 38, and one end of the output shaft 45 thereof is coupled to the drum shaft 38 through a coupling 40 and the other end of the output shaft 45 has a pulse generating plate 45*b* conventionally used and secured thereto. Also, a pulse detecting portion 45*c* is fixed to the outside of the body of the ultrasonic motor, and with the pulse generating plate 45*b*, it constitutes an encoder unit. The pulse detecting portion 45*c* reads an optical pattern formed on the plate 45*b* by combination of the light source and light receiving element.

Figure 9:
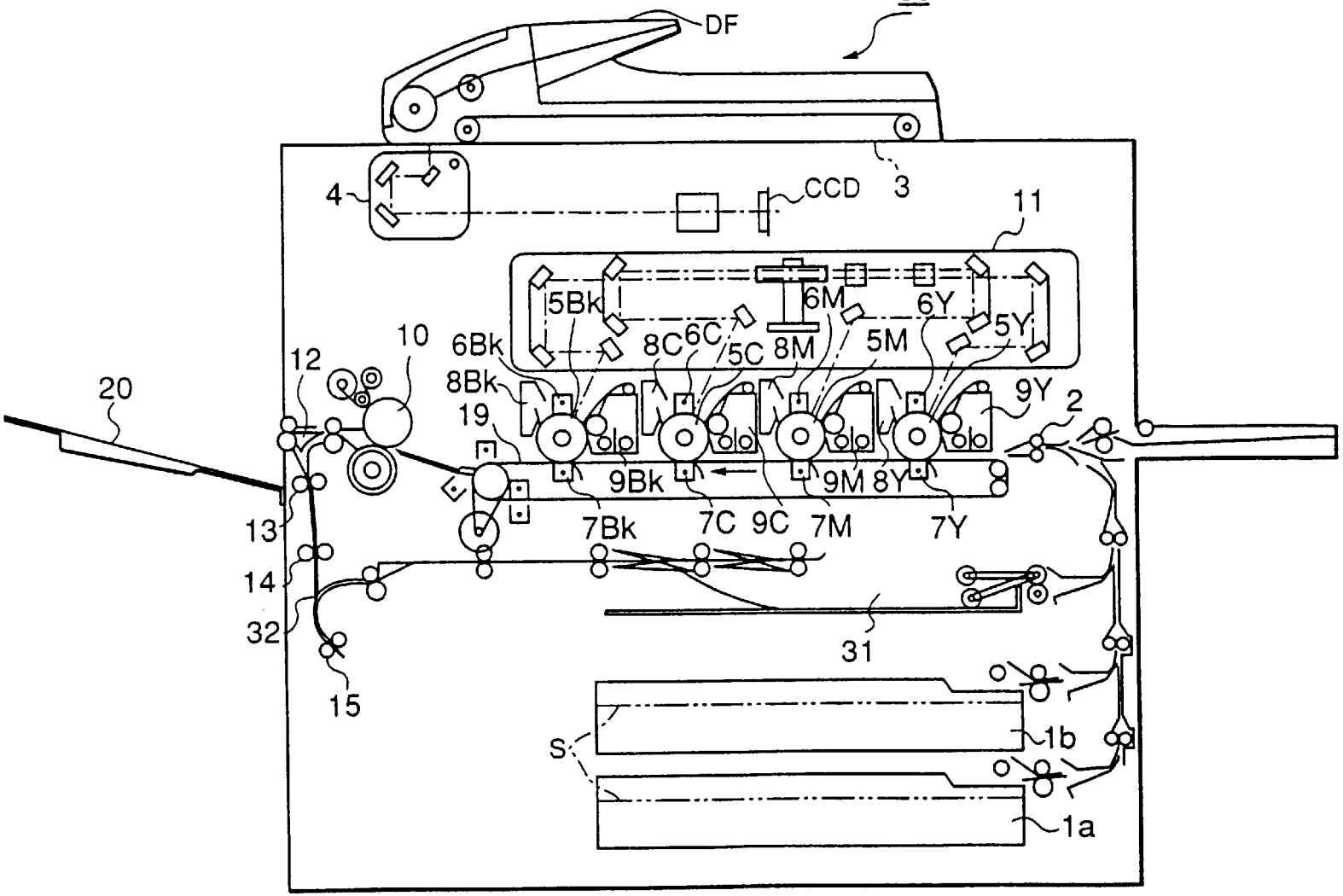
FIG. 9 PRIOR ART
FIG. 9 schematically shows the construction of an example of the full color image forming apparatus according to the prior art.

In the present embodiment, the driving portion shown in FIG. 1 is installed for each photosensitive drum of the full color image forming apparatus shown in FIG. 9.

Figure 2:
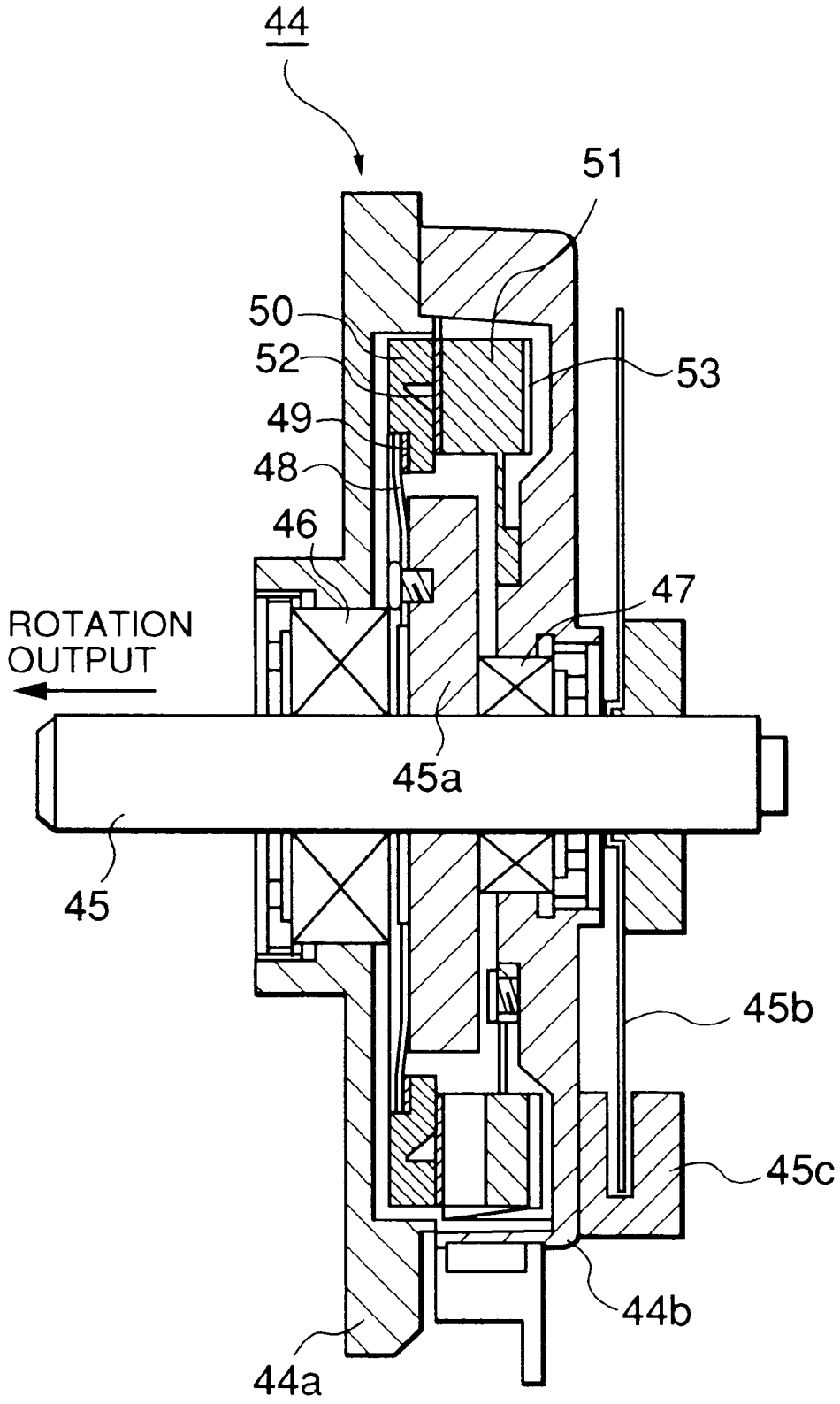
FIG. 2 is a cross-sectional view showing an ultrasonic motor used in the photosensitive drum driving construction of FIG. 1.

FIG. 2 shows the more detailed construction of the ultrasonic motor 44 shown in FIG. 1. In FIG. 2, the output shaft 45 of the ultrasonic motor 44 has secured thereto ball bearings 46 and 47 in opposed relationship with each other, and a stator 51 is fixed to the ball bearing 47. The stator 51 comprises a resilient plate made of phosphor bronze or stainless steel, and a piezoelectric element 53 which is piezoelectric ceramics is attached to the outer peripheral side surface of the stator 51.

A ring-like rotor 50 made of an aluminum alloy is disposed in opposed and concentric relationship with the stator 51, and engineering plastic 52 is attached to the surface of contact thereof opposed to the stator 51. The engineering plastic 52 has such a coefficient of friction that a stable frictional force is obtained in order to contact with the stator 51 and transmit a drive force to the rotor 50 highly efficiently.

A rubber sheet 49 is sticked on the opposite side of the engineering plastic 52 of the rotor 51, and a circular ring-like leaf spring 48 for biasing the rotor 50 toward the stator 51 side through this rubber sheet 49 is fixed to a flange portion 45*a* integrally secured to the output shaft 45. The circumferential portion of the end of the leaf spring 48 is in pressure contact with the rubber sheet 49 and by the biasing force thereof, the surface of the engineering plastic 52 of the rotor 50 is brought into pressure contact with the stator 51.

Cases 44*a* and 44*b* for covering the rotor 50 and the stator 51, respectively, are provided outside the rotor 50 and the stator 51.

That is, in the ultrasonic motor 44, the output shaft 45 is always subjected to an axial force.

Also, the pulse generating plate 45*b* secured to the output shaft 45 and the pulse detecting portion 45*c* fixed to the case 44*b* for reading a pulse are disposed outside the case 44*b* covering the stator 51 as previously described, and these together form an encoder unit.

In the above-described construction, during the operation of the ultrasonic motor, a signal from the pulse detecting portion 45*c* is sent to a motor drive control portion (not shown), and an applied voltage to the piezoelectric element 53 attached to the stator 51 is changed in conformity with the situation while the state (the presence or absence of the fluctuation of the speed) of the output shaft 45 is confirmed, whereby desired accuracy of rotation is obtained.

The number of rotations at that time is not so high (about 150 rpm or greater) as the DC motor but is low (less than 150 rpm) because the output shaft 45 is always urged, that is, because the rotor is always brought into pressure contact with the stator by the biasing force of the leaf spring. Therefore, it becomes possible to effect the driving of the photosensitive drum in a state in which the drum shaft 38 and the output shaft 45 are directly connected together by the coupling 40, that is, a state in which the speed reducing means of FIG. 10 (the timing belt and the pulleys) is not required.

Thus, in the above-described construction, the output of the output shaft 45 of the ultrasonic motor 44 can be transmitted to the photosensitive drum without the accuracy of rotation of the output shaft 45 being reduced by the drive transmitting element such as a drive transmitting belt.

Figure 10:
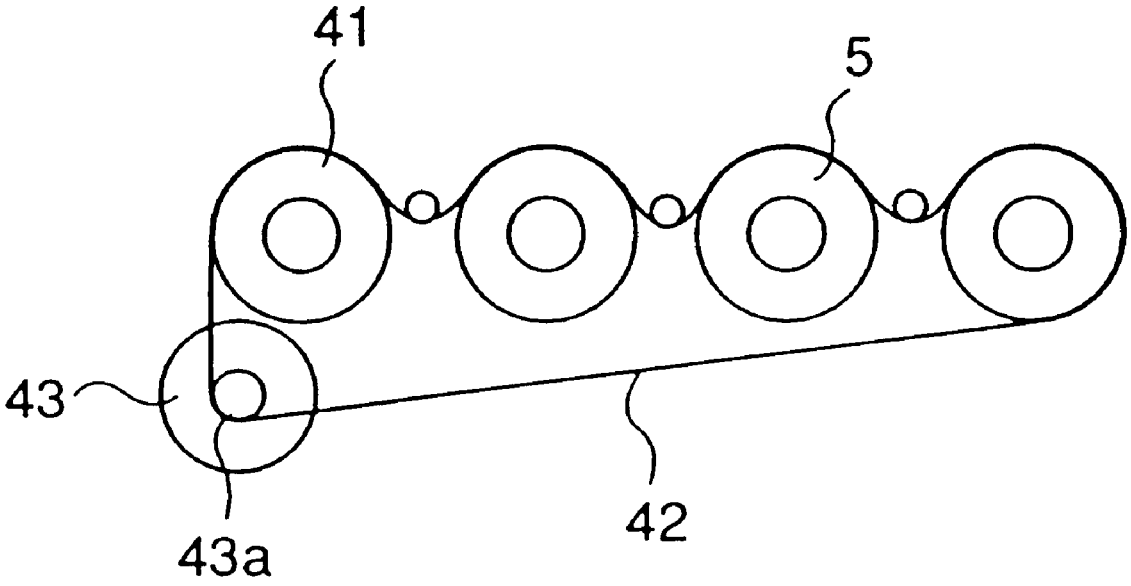
FIG. 10 PRIOR ART
FIG. 10 is an illustration showing the photosensitive drum driving construction in the apparatus of FIG. 9.

Usually, as in the example shown in FIG. 10, when the DC motor rotating at high speed drives a plurality of photosensitive drums by the belt/pulleys or the like, the fluctuation of a load caused to the photosensitive drums is not quickly transmitted to the DC motor because a mechanical element such as a speed reduction mechanism and drive transmitting belt intervenes between the DC motor and the photosensitive drums, and therefore the responsiveness to the fluctuation of the load is bad. Also, the output shaft of the DC motor heretofore used is journalled to the case of the motor itself by ball bearings or the like without being subjected to a braking force and therefore the rotation force of the output shaft is affected and rotation thereof is liable to be fluctuated even by a slight extraneous force or the like, so that the fluctuation is apt to continue during the image formation.

However, when as in the present embodiment, the photosensitive drum is directly driven by the ultrasonic motor, the fluctuation of the load is directly detected by detecting means provided on the rotation shaft of the ultrasonic motor and on the basis of the signal thereof, the rotation is controlled. Therefore the responsiveness to the fluctuation of the load becomes markedly quick as compared with that of the DC motor. In addition, the output shaft itself is subjected to the pressure contact force by the biasing force of the leaf spring 48, so, it is difficult for the output shaft to be subjected to the influence of the fluctuation of the rotation by any extraneous force.

Figure 3:
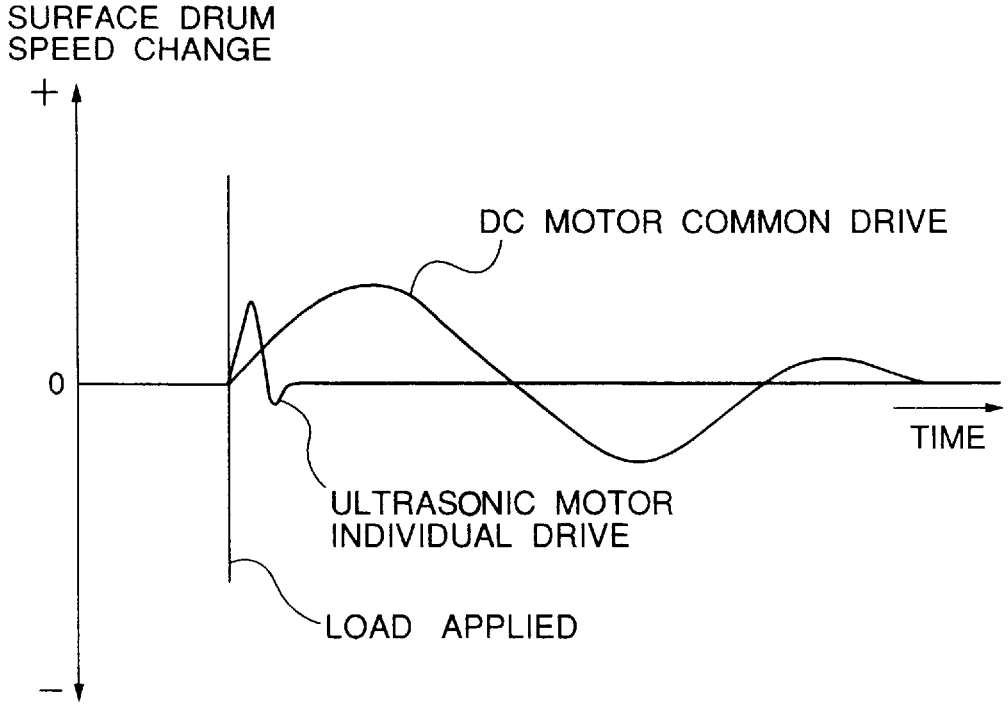
FIG. 3 is a graph showing the behaviors of the ultrasonic motor and a DC motor for the fluctuation of a load.

FIG. 3 is a graph showing a change in the surface speed (the fluctuation of the output) of the drum for the fluctuations of the load of the DC motor and the ultrasonic motor. As will be understood from this graph, as compared with the DC motor, the ultrasonic motor quickly responses to the fluctuation of the load and the change in the surface speed of the drum is immediately settled.

Figure 4:
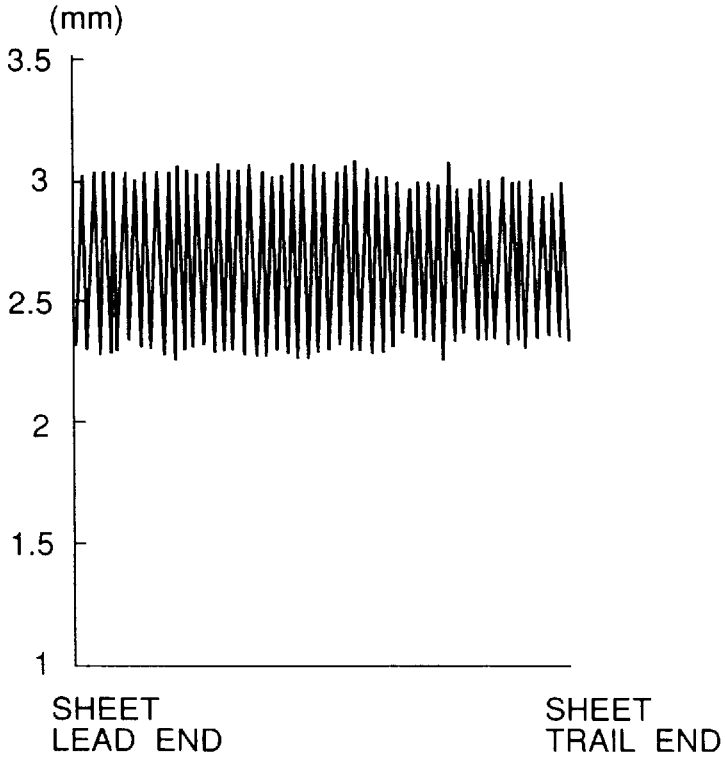
FIG. 4 is a graph representing data from an image shown in FIG. 14 which has been outputted in an apparatus embodying the present invention.
Figure 14:
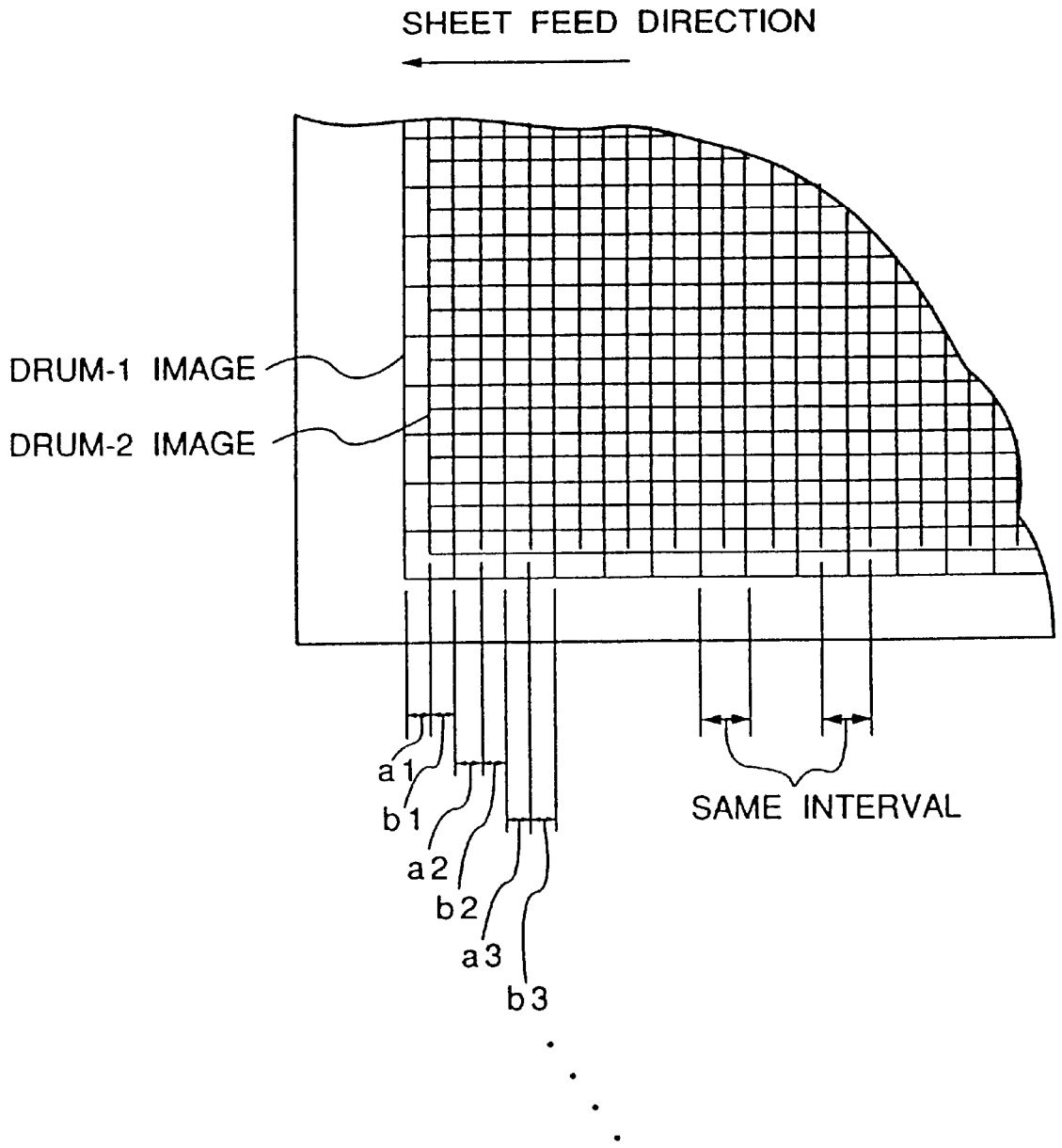
FIG. 14 PRIOR ART
FIG. 14 is an illustration of an image formed for the measurement of image behavior.
Figure 15:
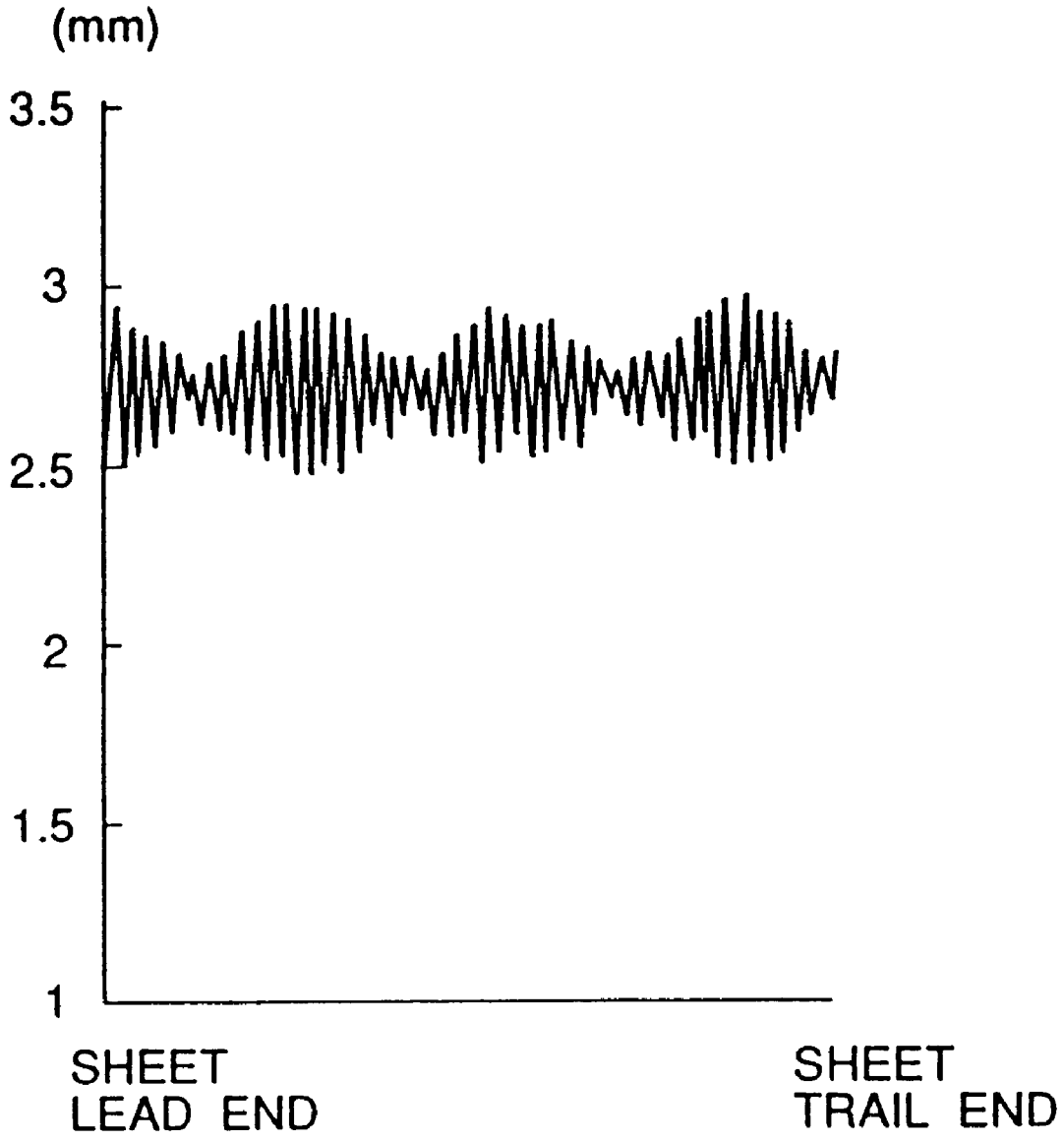
FIG. 15 PRIOR ART
FIG. 15 is a graph representing data from the image shown in FIG. 14 which has been outputted in the apparatus of FIG. 9.

FIG. 4 shows the graph of the image shown in FIG. 14 formed in the image forming apparatus embodying the present invention and the values of $a_1$ to $a_n$ and $b_1$ to $b_n$ in FIG. 14 (this graph corresponds to the graph of FIG. 15). As is apparent from the graph of FIG. 4, fluctuations such as great peaks/valleys do not occur and therefore, as compared with the graph of FIG. 15, the amount of deviation between images is markedly decreased.

Figure 5A:
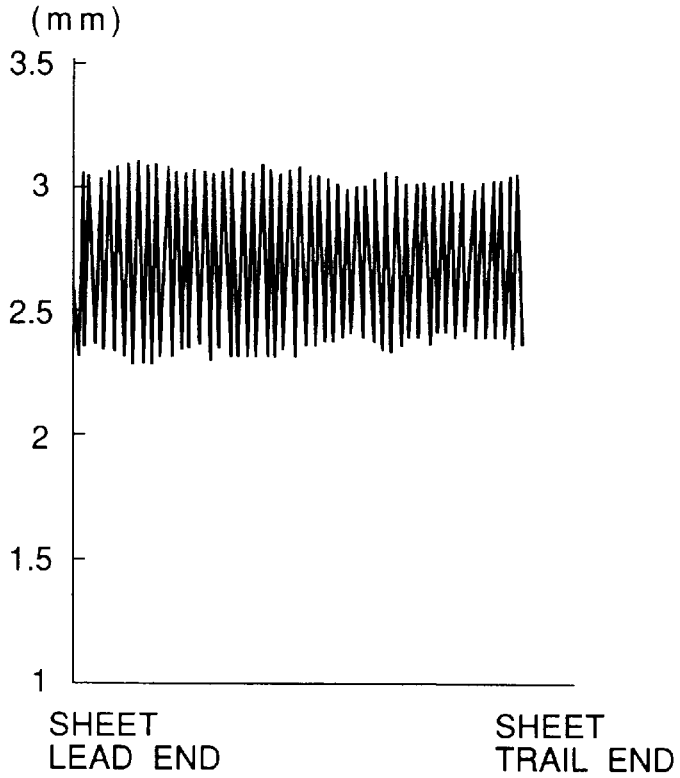
FIGS. 5A and 5B are graphs representing changes in data obtained when the relative relation between photosensitive drums has been changed in the above apparatus.
Figure 5B:
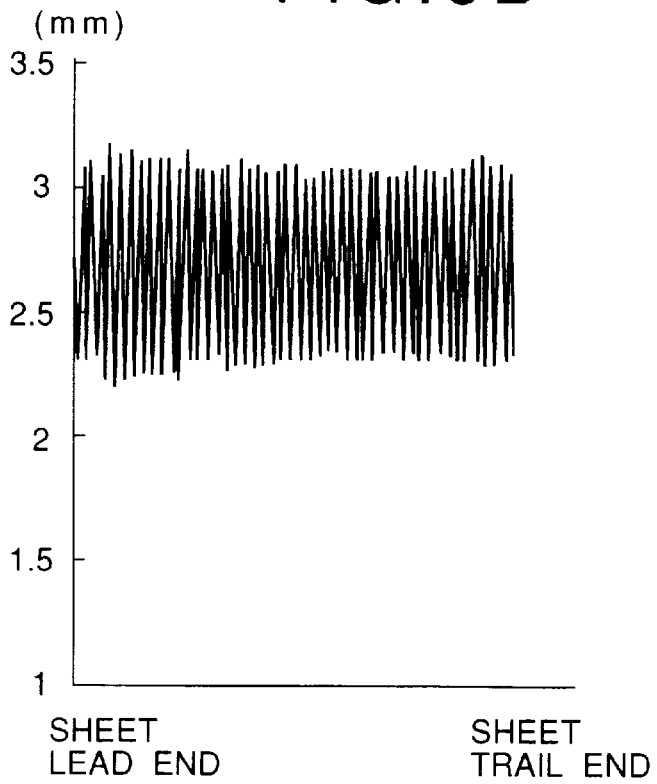
Figure 16A:
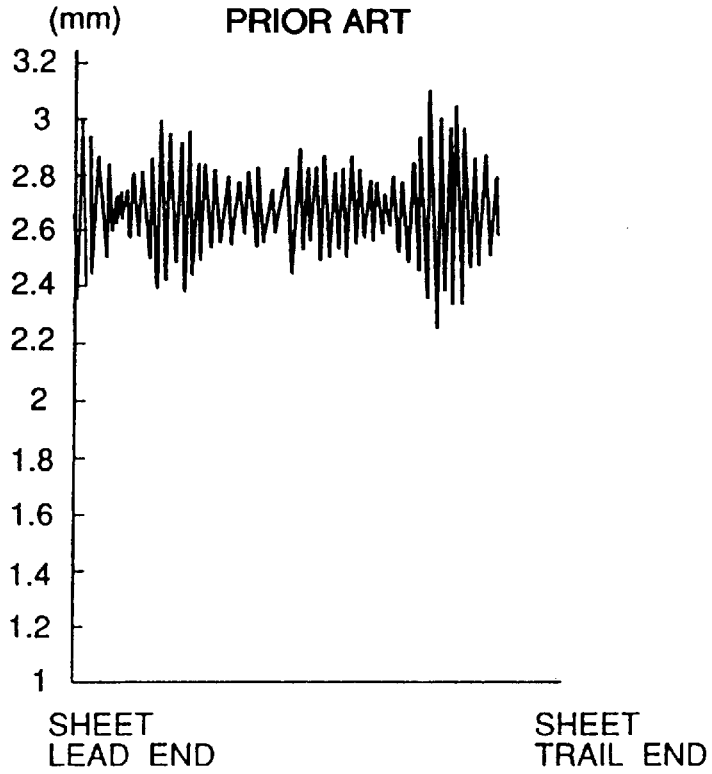
FIG. 16A PRIOR ART
FIGS. 16A and 16B are graphs representing changes in data obtained when the relative relation between the photosensitive drums has been changed in the apparatus of FIG. 9.
Figure 16B:
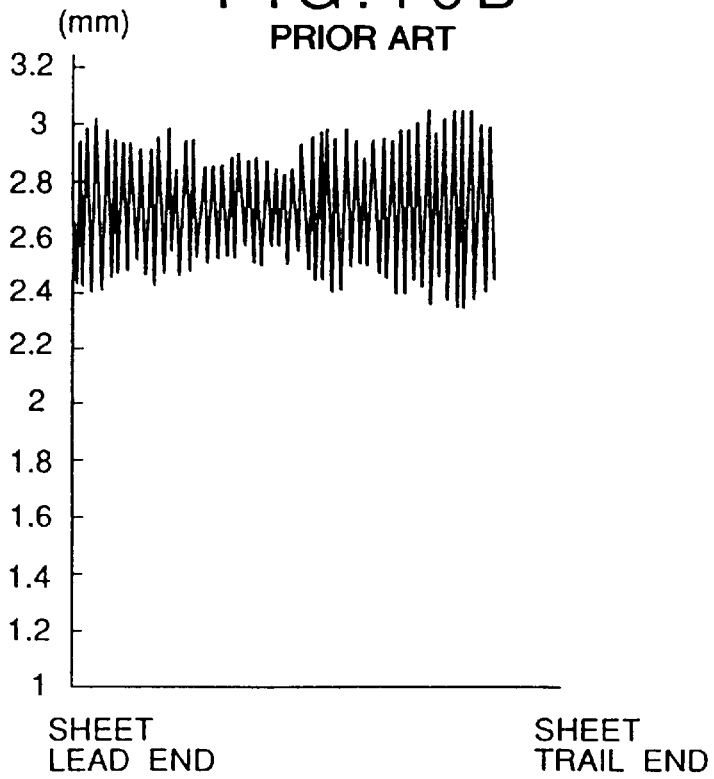
FIG. 16B PRIOR ART

FIGS. 5A and 5B show an example in which the change of the relative position between the shaft and flange when attaching them to the shaft and two photosensitive drums effected when the graphs of FIGS. 16A and 16B were obtained was effected in the apparatus according to the present embodiment. Between FIGS. 5A and 5B, the change in the behavior thereof is little as compared with that in FIGS. 16A and 16B. That is, even if the relation between the drum shafts of the respective photosensitive drums is made arbitrary, constant images can always be obtained, and also during the assemblage of the apparatus and the interchange of the photosensitive drums, any special care becomes unnecessary.

Figure 6:
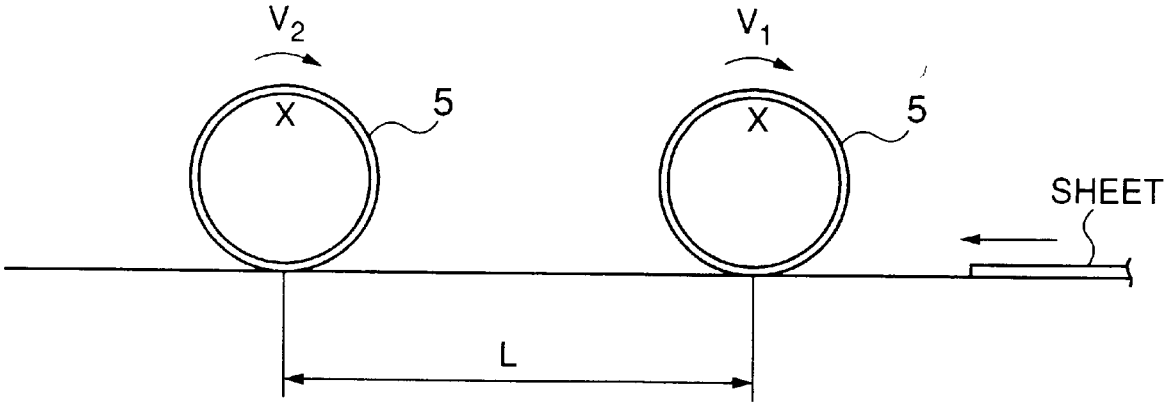
FIG. 6 is an illustration for illustrating the measuring positions for the speeds of the photosensitive drums in the above apparatus.
Figure 7A:
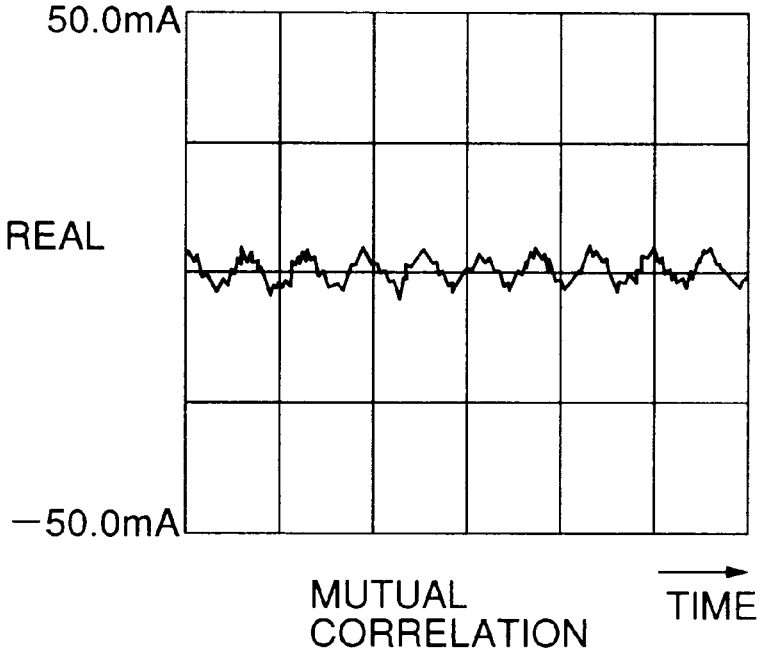
FIGS. 7A and 7B are graphs representing changes in data obtained when the relative relation between the photosensitive drums has been changed in the above apparatus, FIG. 7A being a mutual correlation graph, and FIG. 7B being a graph obtained by frequency-analyzing FIG. 7A.
Figure 7B:
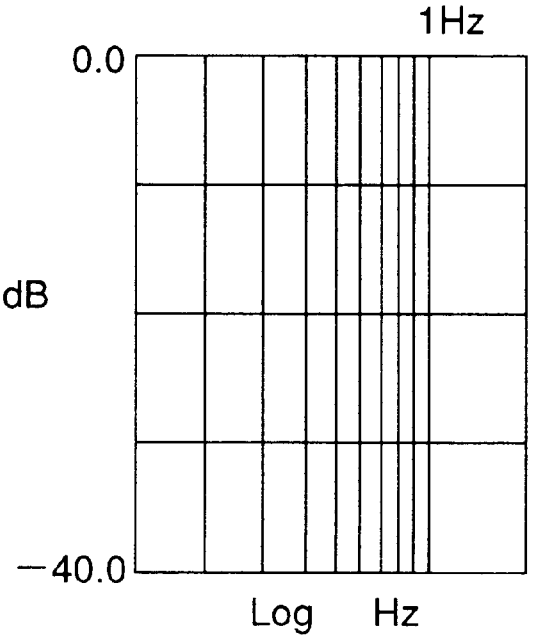

Next, as shown in FIG. 6, points X which are the measuring points of the two photosensitive drums 5 are measured by a laser Doppler speedometer, and the mutual correlation between the two speeds ($V_1$ and $V_2$) thereof and the result of the frequency analysis thereof are shown in FIGS. 7A and 7B. As is apparent from FIG. 7B, the frequency component for each one full rotation of the photosensitive drum does not affect between the speeds of the two photosensitive drums. That is, this is the result shown in FIGS. 6, 7A and 7B.

Figure 8A:
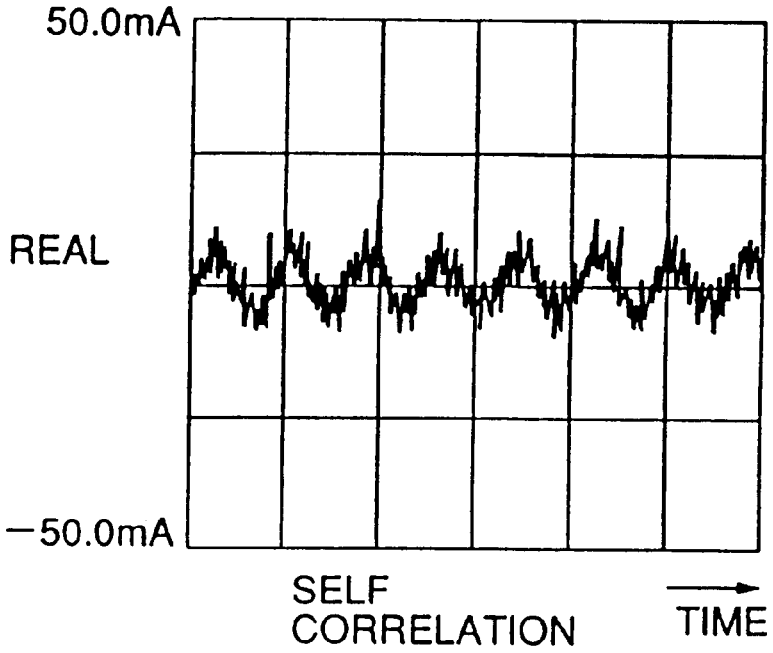
FIG. 8A is a graph showing the self-correlation function of the speed obtained in FIG. 6.
Figure 8B:
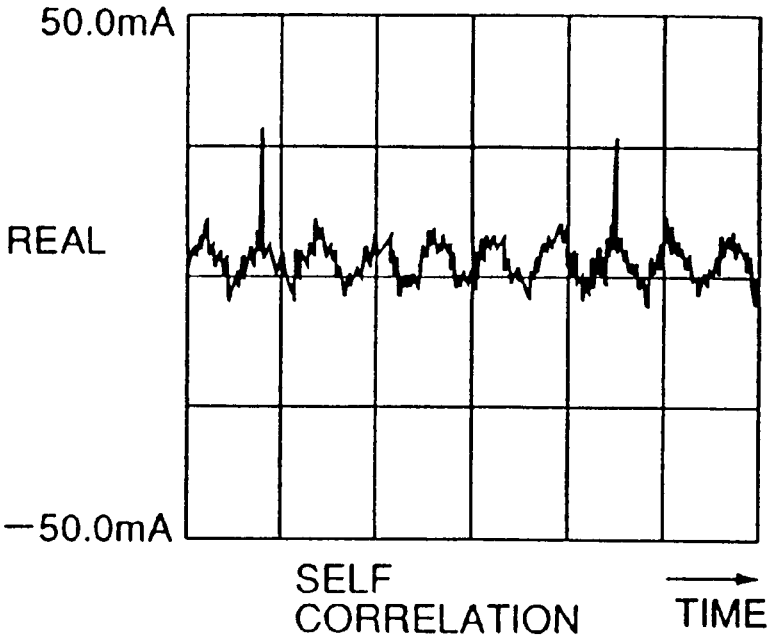
FIG. 8B PRIOR ART
FIG. 8B is a graph showing the self-correlation function of the speed obtained in FIG. 17.
Figure 17:
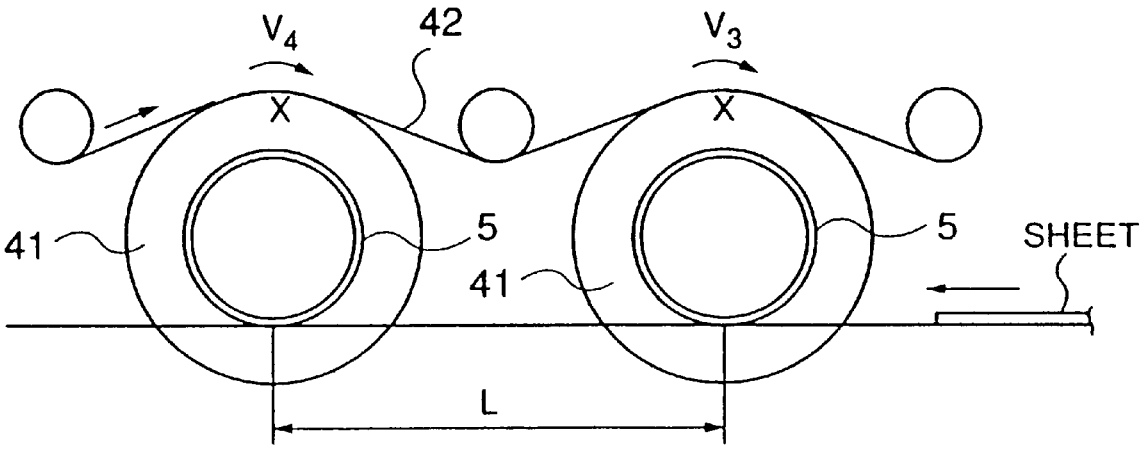
FIG. 17 PRIOR ART
FIG. 17 is an illustration for illustrating the measuring positions for the speeds of the photosensitive drums in the apparatus of FIG. 9.
Figure 18A:
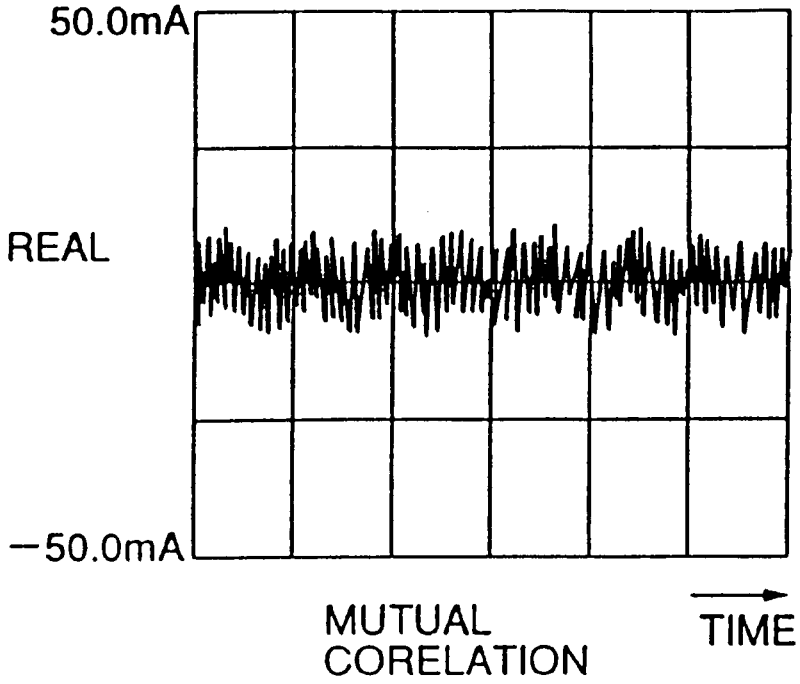
FIG. 18A PRIOR ART
FIG. 18A is a graph showing the mutual correlation function between the speeds obtained in FIG. 17.
Figure 18B:
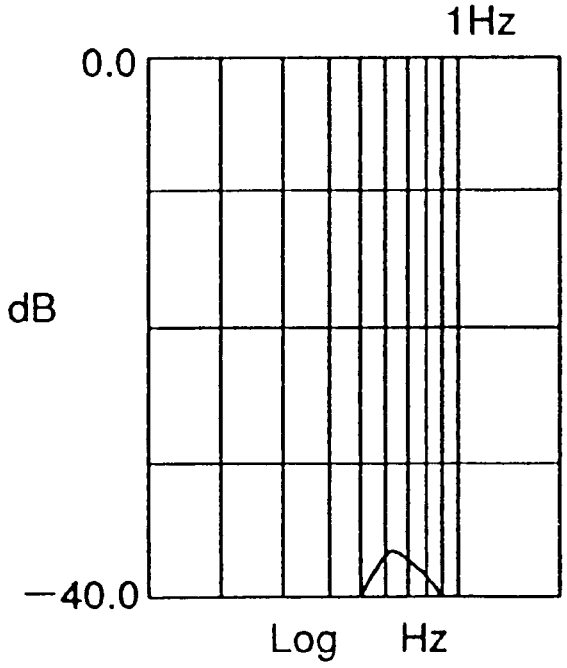
FIG. 18B PRIOR ART
FIG. 18B is a graph showing the result of the frequency analysis of the graph of FIG. 18A.

The self-correlation functions of the speed $V_3$ in FIG. 17 (the speed of the photosensitive drums when driven in common by the DC motor) and the speed $V_1$ in FIG. 6 (the speed of the photosensitive drums when individually driven by the ultrasonic motor) are shown in FIGS. 8A and 8B. In FIG. 8A, the fluctuation for each one full rotation of the photosensitive drum is not seen, whereas in FIG. 8B, the fluctuation for each one full rotation of the photosensitive drum appears clearly. That is, it is seen that when the photosensitive drums are individually driven by the ultrasonic motor, the fluctuation for each one full rotation of the photosensitive drum is controlled and decreased, as compared with the case where the photosensitive drums are driven in common by the DC motor.

As is apparent from the foregoing description, in the image forming apparatus of the present invention, a drive source for individually and directly driving each image bearing member is disposed near each image bearing member, the drive source has detecting means for receiving a load in a rotation generating portion and detecting the rotated state of the rotary output shaft thereof, and the rotation of the rotary output shaft is controlled on the basis of the detection signal of the detecting means. Therefore, the speed controlling function of the drive source can effectively make the image bearing members work and the fluctuation of the image for each one full rotation of the image bearing members can be suppressed. Accordingly, images of high quality free of any fluctuation in images can be obtained.

Also, during the assemblage of the apparatus body and the interchange of the image bearing members, any special care and procedure are not required of an operation and stable images can be obtained.

In addition, by providing the detect means for controlling rotation of the ultrasonic motor directly to the rotation shaft of the motor as shown in the embodiment, not only, detecting accuracy can be improved but also the motor and the rotation detect means can be used continuously, without exchanging or wasting them. That is, when attaching the member such as photosensitive drum to the rotation shaft, it is enough to remove only the photosensitive drum.

Further, when the rotation amount detect means such the encoder is provided along the housing of motor, component members or element can be disposed in the apparatus extremely effectively. When the motor and the rotation amount detect means are disposed coaxially, and the photosensitive drum is supported by the shaft attached to the shaft by the attaching member, not only strength of the motor is increased but also the motor needs not be removed in every time when exchanging the photosensitive drum as the exhausting and exchanging of the photosensitive drum, so that any troublesome adjusting is unnecessary.

Meanwhile, as the rotation amount detect means for detecting rotation of the drum shaft, various type detect means in addition to the above mentioned optical type.

What is claimed is:

1. An image forming apparatus for forming multiple images onto a transfer material by transferring color toner images sequentially, comprising:

a plurality of image bearing members arranged side by side;

image formation means having a digital exposing means for forming a toner image on each of said image bearing members;

convey means for conveying a transfer material to toner image transfer positions sequentially;

transfer means for transferring the toner image formed on each of said image bearing members to the transfer material at the transfer positions; and a plurality of ultrasonic motors provided corresponding to each of said image bearing members for rotating them, each of said ultrasonic motors being provided coaxial with each of said image bearing members and coupled therewith by a coupling member, each of said ultrasonic motors having rotation detection means on a rotation shaft thereof for detecting rotation speed of the ultrasonic motor, wherein the rotation speed of each ultrasonic motor is controlled independently based on a detected result by said rotation detection means to make the rotation speed of each ultrasonic motor uniform.

2. An image forming apparatus according to claim 1, wherein said rotation detection means is a rotary disc disposed in a plane orthogonal to a rotation shaft of said ultrasonic motor.

3. An image forming apparatus according to claim 1, wherein said rotation detection means is constructed integrally with said ultrasonic motor.

4. An image forming apparatus according to claim 1, wherein said image bearing members are mounted on rotation shafts driven by said ultrasonic motors.

5. An image forming apparatus according to claim 1, wherein a rotation shaft on which said rotation detection means is mounted and a rotation shaft supporting each of said image bearing members are connected by a connect member.

6. An image forming apparatus according to claim 1, wherein each of said ultrasonic motors includes a stator and a rotor coaxial therewith and rotatable thereto, and the rotor is urged to the stator axially by an urge member.

7. An image forming apparatus for forming multiple images onto a transfer material by transferring color toner images sequentially, comprising:

a plurality of electrophotographic photosensitive members arranged side by side;

image formation means having a digital exposing means for forming a toner image on each of said photosensitive members;

convey means for conveying a transfer material to toner image transfer positions sequentially;

transfer means for transferring the toner images formed on each of said photosensitive members to the transfer material at the transfer positions; and a plurality of ultrasonic motors provided corresponding to each of said photosensitive members for rotating them, each of said ultrasonic motors being provided coaxial with each of said photosensitive members and coupled therewith by a coupling member, each of said ultrasonic motors having rotation detection means on a rotation shaft thereof for detecting rotation speed of the ultrasonic motor, wherein the rotation speed of each ultrasonic motor is controlled independently based on a detected result by said rotation detection means to make the rotation speed of each ultrasonic motor uniform.

8. An image forming apparatus according to claim 7, wherein said rotation detection means includes a rotary disc disposed in a plane orthogonal to a rotation shaft of said ultrasonic motor, and read means for optically reading a pattern formed on the disc.

9. An image forming apparatus according to claim 8, wherein said rotation detection means is constructed integrally with said ultrasonic motor.

10. An image forming apparatus according to claim 7, wherein each of said photosensitive members is mounted on a rotation shaft driven by one of said ultrasonic motors.

11. An image forming apparatus according to claim 7, wherein a rotation shaft on which said rotation detect means is mounted and a rotation shaft supporting each of said photosensitive members are connected by a connect member.

12. An image forming apparatus for forming multiple images onto a transfer material by transferring color toner images sequentially, comprising:

a plurality of electrophotographic photosensitive members arranged side by side;

image formation means having digital exposing means for forming a toner image on each of said photosensitive members;

convey means for conveying a transfer material to toner image transfer positions sequentially;

a transfer member to which a bias is applied to transfer the toner image formed on each of said photosensitive members to the transfer material at the transfer positions; and a plurality of ultrasonic motors provided corresponding to each of said photosensitive members for rotating them, each of said ultrasonic motors being provided coaxial with each of said photosensitive members and coupled therewith by a coupling member, each of said ultrasonic motors having an encoder on a rotation shaft thereof for detecting rotation speed of the ultrasonic motor, wherein the rotation speed of each ultrasonic motor is controlled independently based on a detected result by the encoder to make the rotation speed of each ultrasonic motor uniform.

13. An image forming apparatus according to claim 12, wherein said encoder includes a rotary disc disposed in a plane orthogonal to a rotation shaft of said ultrasonic motors, and read means for optically reading a pattern formed on the disc.

14. An image forming apparatus according to claim 12, wherein each of said photosensitive members is attached to a rotation shaft driven by one of said ultrasonic motors.

15. An image forming apparatus for forming multiple images onto a transfer material, comprising:

a plurality of image bearing members arranged side by side;

image formation means having a digital exposing means for forming a toner image on each of said image bearing members;

convey means for conveying a transfer material to toner image transfer positions sequentially;

transfer means for transferring the toner image formed an each of said image bearing members to the transfer material at the transfer positions; and a plurality of ultrasonic motors provided corresponding to each of said image bearing members for rotating them, each of said ultrasonic motors being provided coaxial with each of said image bearing members and coupled therewith by a coupling member, each of said ultrasonic motors having rotation detection means on a rotation shaft thereof for detecting rotation speed of the ultrasonic motor, wherein the rotation speed of each ultrasonic motor is controlled independently based on a detected result by said rotation detection means to make the rotation speed of each ultrasonic motor uniform.

16. An image forming apparatus for forming multiple images onto a transfer material by sequentially transferring color toner images, comprising:

a plurality of electrophotographic photosensitive drum members arranged side by side;

image formation means having a digital exposing means for forming a toner image on each of said photosensitive drum members;

convey means for sequentially conveying a transfer material to toner image transfer positions;

transfer means for transferring the toner image formed on each of said photosensitive drum members to the transfer material at the transfer positions; and a plurality of ultrasonic motors provided corresponding to each of said photosensitive drum members for rotating said photosensitive drum members, each of said ultrasonic motors being provided coaxially with each of said photosensitive drum members, each of said ultrasonic motors having rotation detection means on a rotation shaft thereof for detecting a rotation speed of the each said ultrasonic motors, and each of said photosensitive drum members having a stopper, which fixes each of said photosensitive drum members to the corresponding rotation shaft for supporting each of said photosensitive drum members opposite to a side where each of said ultrasonic motors is disposed.

wherein the rotation speed of each ultrasonic motor is controlled independently based on a detected result by said rotation detection means to make the rotation speed of each ultrasonic motor uniform.

17. An image forming apparatus according to claim 16, wherein each said rotation detection means is a rotary disc disposed in a plane orthogonal to a rotation shaft.

18. An image forming apparatus according to claim 16 wherein each said rotation detection means is constructed integrally with each of said ultasonic motors.

19. An image forming apparatus according to claim 16, wherein each said rotation detection means includes a a rotary disc disposed in a plane orthogonal to the rotation shaft and a read means for optically reading a pattern formed on the disc.

20. An image forming apparatus according to claim 19, wherein each said rotation detection means is constructed integrally with each of said ultrasonic motors.

21. An image forming apparatus for forming multiple images onto a transfer material by sequentially transferring color toner images, comprising:

a plurality of electrophotographic photosensitive drum members arranged side by side;

image formation means having a digital exposing means for forming a toner image on each of said photosensitive drum members;

transfer means for transferring the toner images at the transfer positions; and a plurality of ultrasonic motors provided corresponding to each of said photosensitive drum members for rotating said photosensitive drum members, each of said ultrasonic motors being provided coaxially with each of said photosensitive drum members, each of said ultrasonic motors having rotation detection means on a rotation shaft thereof for detecting a rotation speed of each said ultrasonic motors, and each of said photosensitive drum members having a stopper, which fixes each of said photosensitive drum members to the corresponding rotation shaft for supporting each of said photosensitive drum members on a side of the rotation shaft opposite to a side where each of said ultrasonic motors is disposed.

wherein the rotation speed of each ultrasonic motor is controlled independently based on a detected result by said rotation detection means to make the rotation speed of each ultrasonic motor uniform.

22. An image forming apparatus according to claim 21, wherein each said rotation detection means is a rotary disc disposed in a plane orthogonal to a rotation shaft.

23. An image forming apparatus according to claim 21, wherein each said rotation detection means is constructed integrally with each of said plurality of ultrasonic motors.

24. An image forming apparatus according to claim 21, wherein each said rotation detection means includes a rotary disc disposed in a plane orthogonal to each said rotation shaft and a read means for optically reading a pattern formed on the disc.

25. An image forming apparatus according to claim 24, wherein each said rotation detection means is constructed integrally with each of said plurality of ultrasonic motors.

* * * * *

UNITED STATES PATENT AND TRADEMARK OFFICE

CERTIFICATE OF CORRECTION

PATENT NO. : 6,141,515
DATED : October 31, 2000
INVENTOR(S) : Kenji Takeda, et al.

It is certified that error appears in the above-identified patent and that said Letters Patent is hereby corrected as shown below:

Drawings,
On sheet 16, "CORELATION" should read -- CORRELATION --.

Column 2,
Line 24, "is" should read -- are --; and
Line 59, "photsensitive" should read -- photosensitive --.

Column 7,
Line 1, "sticked on" should read -- made to adhere to --.

Column 9,
Line 30, "type." should read -- type may be used. --.

Column 10,
Line 47, "detect" should read -- detection --.

Column 11,
Line 64, "the each" should read -- each of --.

Column 12,
Line 13, "ultasonic" should read -- ultrasonic --;
Line 15, "a a" should read -- a --;
Line 39, "each" should read -- each of --; and
Line 47, "each ultrasonic motor" should read -- each of said ultrasonic motors --.

Signed and Sealed this

Ninth Day of October, 2001

*Attest:*

Nicholas P. Godici

*Attesting Officer*

NICHOLAS P. GODICI
*Acting Director of the United States Patent and Trademark Office*